US007568954B2

(12) United States Patent
Li et al.

(10) Patent No.: US 7,568,954 B2
(45) Date of Patent: Aug. 4, 2009

(54) ELECTRICAL CONNECTOR

(75) Inventors: Xue Li, Kunshan (CN); Hong-Qiang Han, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,684

(22) Filed: Jun. 19, 2008

(65) Prior Publication Data

US 2008/0318457 A1 Dec. 25, 2008

(30) Foreign Application Priority Data

Jun. 19, 2007 (CN) ..... 200720038736.3

(51) Int. Cl.
*H01R 17/18* (2006.01)

(52) U.S. Cl. ..... 439/668; 439/669

(58) Field of Classification Search ..... 439/668, 439/669, 569

See application file for complete search history.

(56) References Cited

U.S. PATENT DOCUMENTS 4,202,593 A * 5/1980 Abernethy et al. ..... 439/569
6,519,138 B1 2/2003 Oison et al.
6,592,408 B2 * 7/2003 Ma et al. ..... 439/669
6,690,801 B2 2/2004 Yeh
6,808,404 B1 10/2004 Doyle et al.

FOREIGN PATENT DOCUMENTS

CN 3526618 5/2006

* cited by examiner

*Primary Examiner*—Tho D Ta
(74) *Attorney, Agent, or Firm*—Wei Te Chung

(57) ABSTRACT

An electrical connector (100) to be mounted on a peripheral panel (3) and includes an insulative housing (1) defining a mating face, a mounting face, a top wall (10), a bottom wall (11), a pair of side walls (12) interconnecting the top wall and the bottom wall, and a receiving cavity (16) extending through the mating face to receive a mating plug, an ear portion (131) extending laterally from the side wall, a flat retaining plate (121) extending outwardly from the side wall and being coplanar with top wall, a screw hole (132) extending through the ear portion; and a number of contacts retained in the housing.

18 Claims, 8 Drawing Sheets

ELECTRICAL CONNECTOR

BACKGROUND OF THE INVENTION

1. Field of the Invention

The present invention generally relates to an electrical connector and more particularly to an electrical connector to be reliably mounted on a panel.

2. Description of Related Art

A conventional electrical connector is usually used in electrical equipments such as stereo audio equipment, mobile phones and the like for contacting with a mating plug, and mounted on a printed circuit board. The electrical connector comprises an insulative housing defining a front mating face and a receiving cavity extending rearwardly through the insulative housing, and a plurality of contacts retained in the receiving cavity. The contacts each includes a soldering portion mounted on the printed circuit board to secure the electrical connector onto the printed circuit board, then the printed circuit board is secured on a peripheral panel of the electrical equipments to make the receiving cavity of the electrical connector exposed to an user. However, the electrical connector is merely retained by an engagement between the soldering portions and the printed circuit board, an user may apply frequent force to the electrical connector by insertion/retraction of the plug into/from the receiving cavity, the engagement could be destroyed due to long term use. Therefore, there is a need to secure the electrical connector to the peripheral panel more reliably.

It is thus desired to provide an electrical connector having an securing device to engage with a panel.

SUMMARY OF THE INVENTION

According to the present invention, an electrical connector to be mounted on a peripheral panel, includes: an insulative housing defining a mating face, a mounting face, a top wall, a bottom wall, a pair of side walls interconnecting the top wall and the bottom wall, and a receiving cavity extending through the mating face to receive a mating plug, an ear portion extending laterally from the side wall, a flat retaining plate extending outwardly from the side wall and being coplanar with top wall, a screw hole extending through the ear portion; and a number of contacts retained in the housing.

Other objects, advantages and novel features of the present invention will become more apparent from the following detailed description of the present embodiment when taken in conjunction with the accompanying drawings.

DETAILED DESCRIPTION OF THE INVENTION

Figure 1:
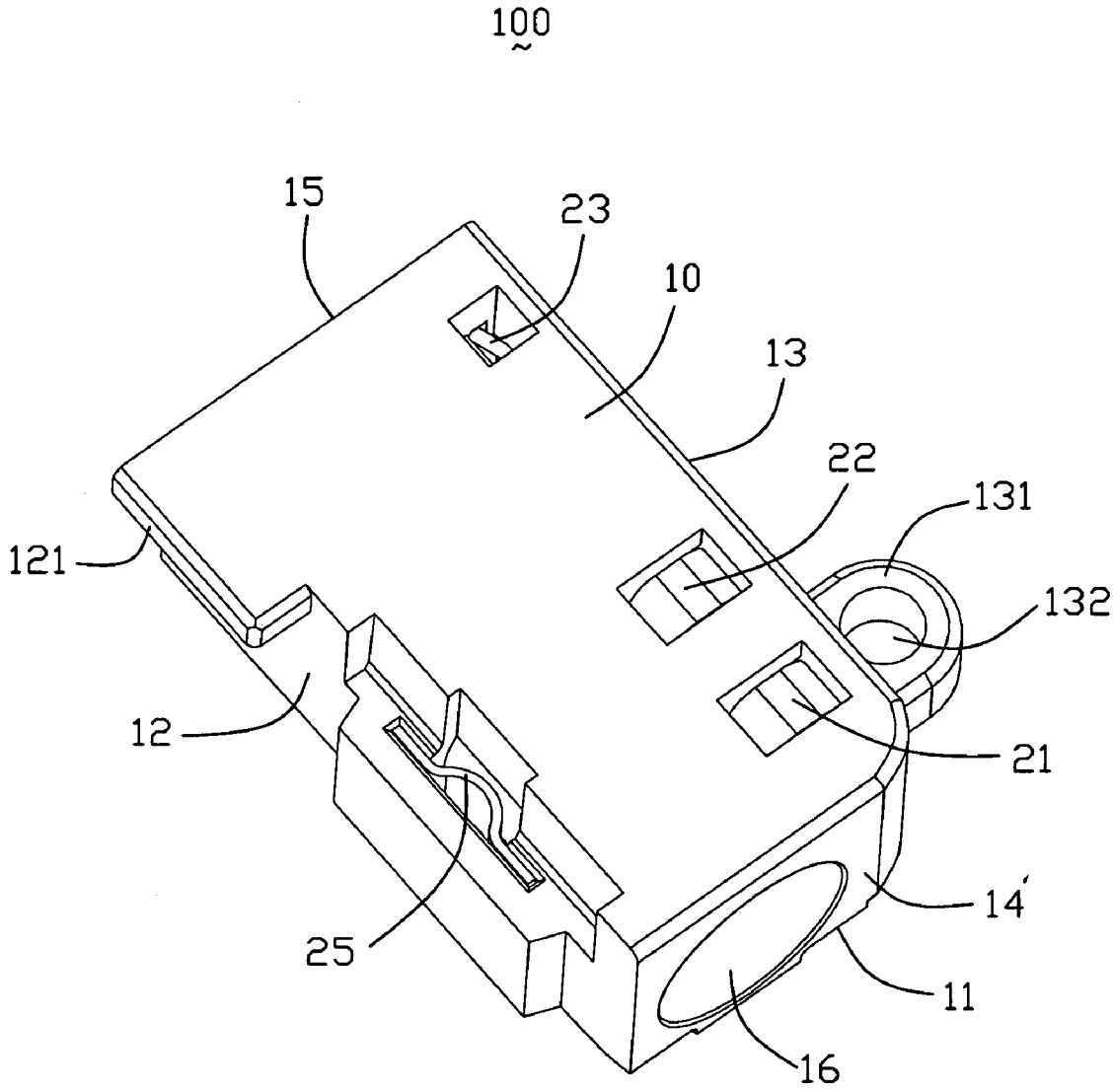
FIG. 1 is an assembled perspective view of an electrical connector according to the present invention.

Reference will now be made to the drawing figures to describe the preferred embodiment of the present invention in detail.

Figure 2:
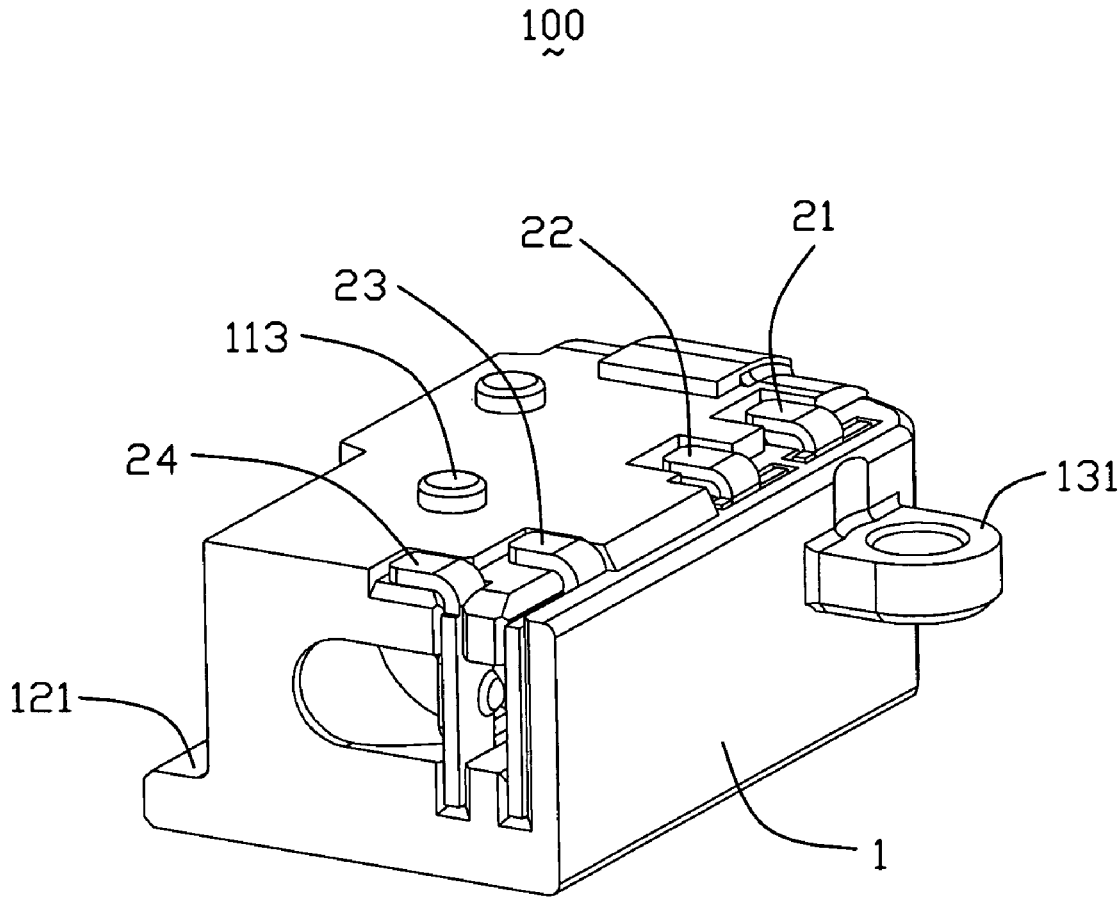
FIG. 2 is a bottom view of the electrical connector.
Figure 3:
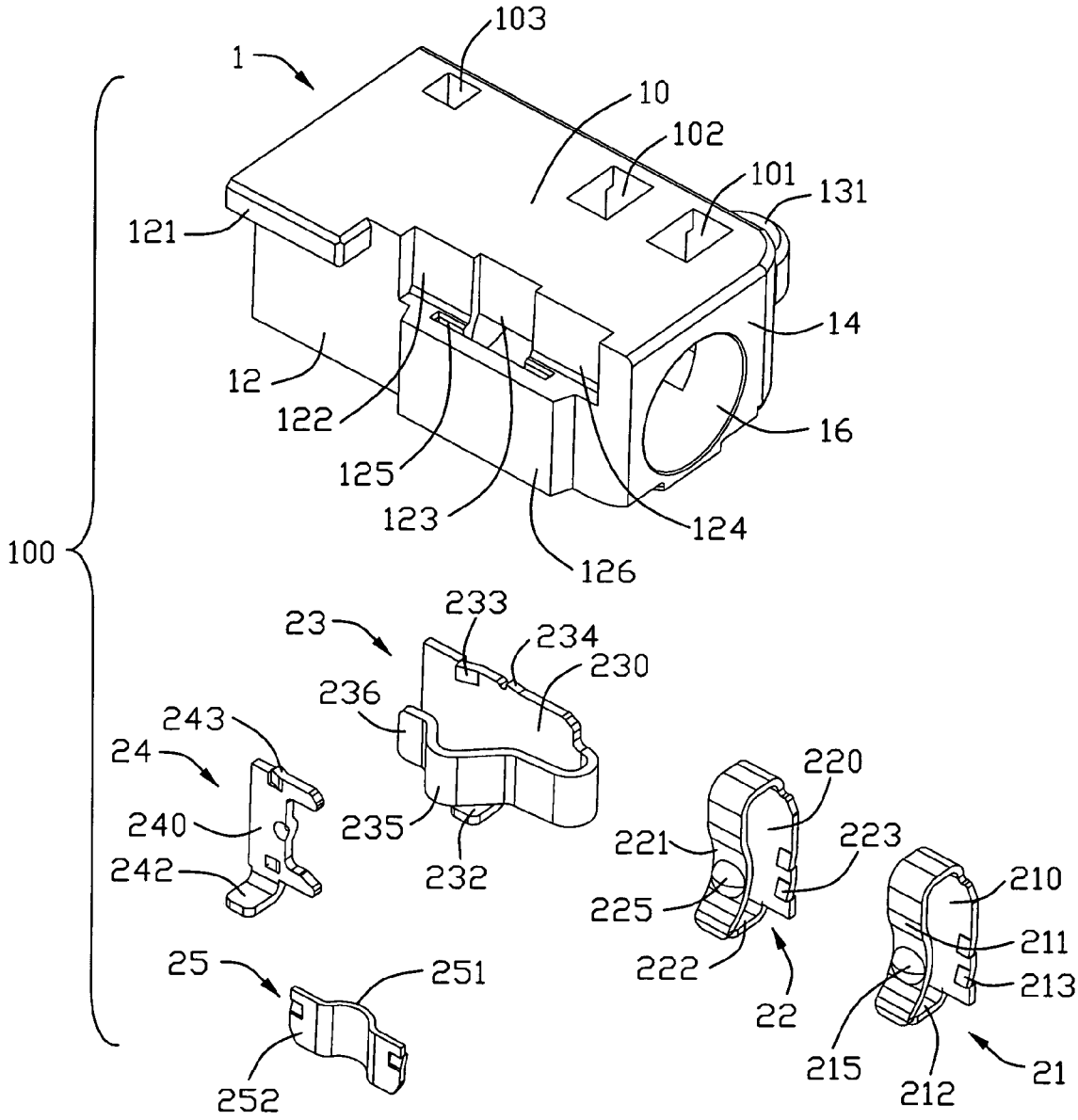
FIG. 3 is an exploded perspective view the electrical connector.
Figure 4:
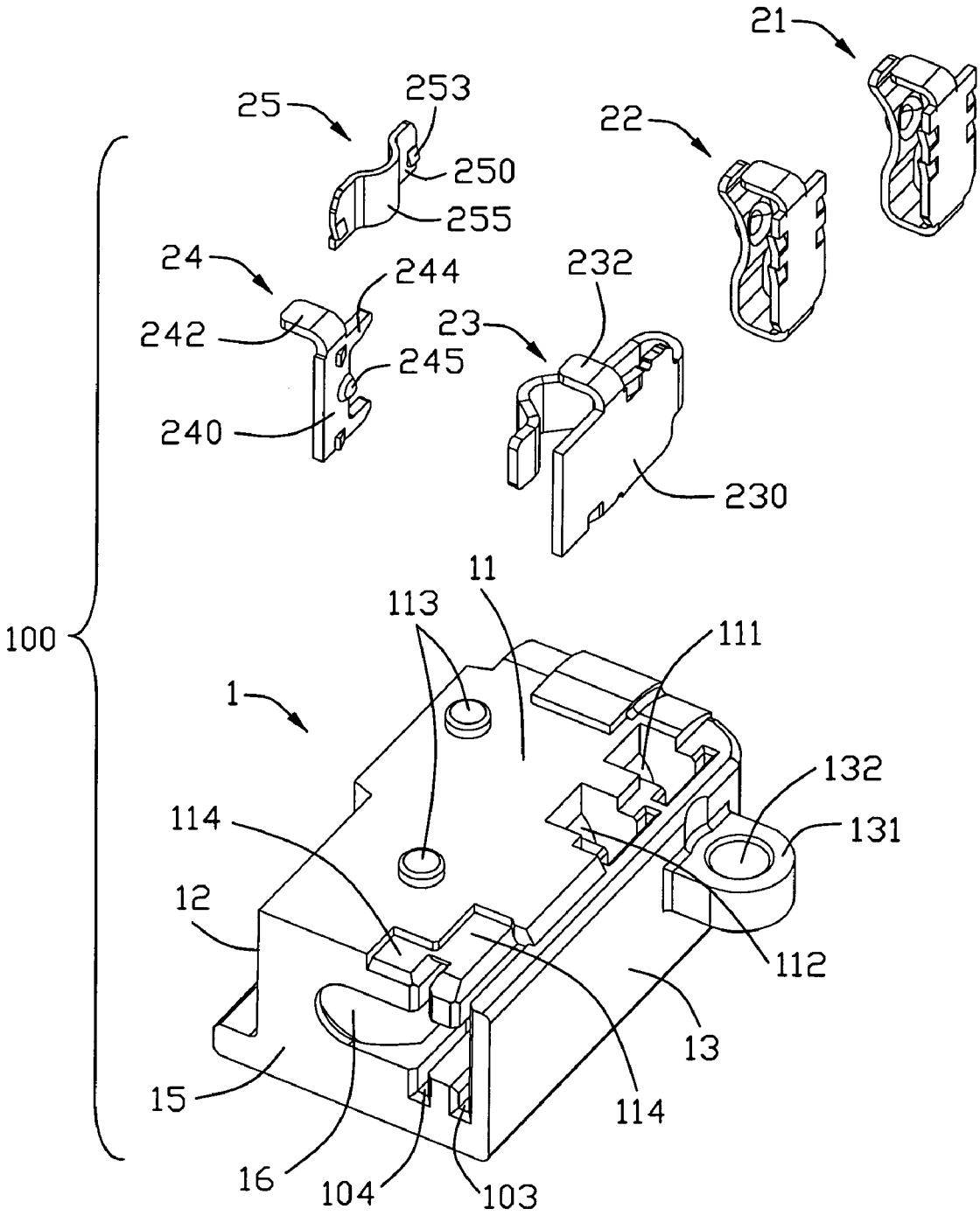
FIG. 4 is a view similar to FIG. 3, while taken from a different aspect.
Figure 5:
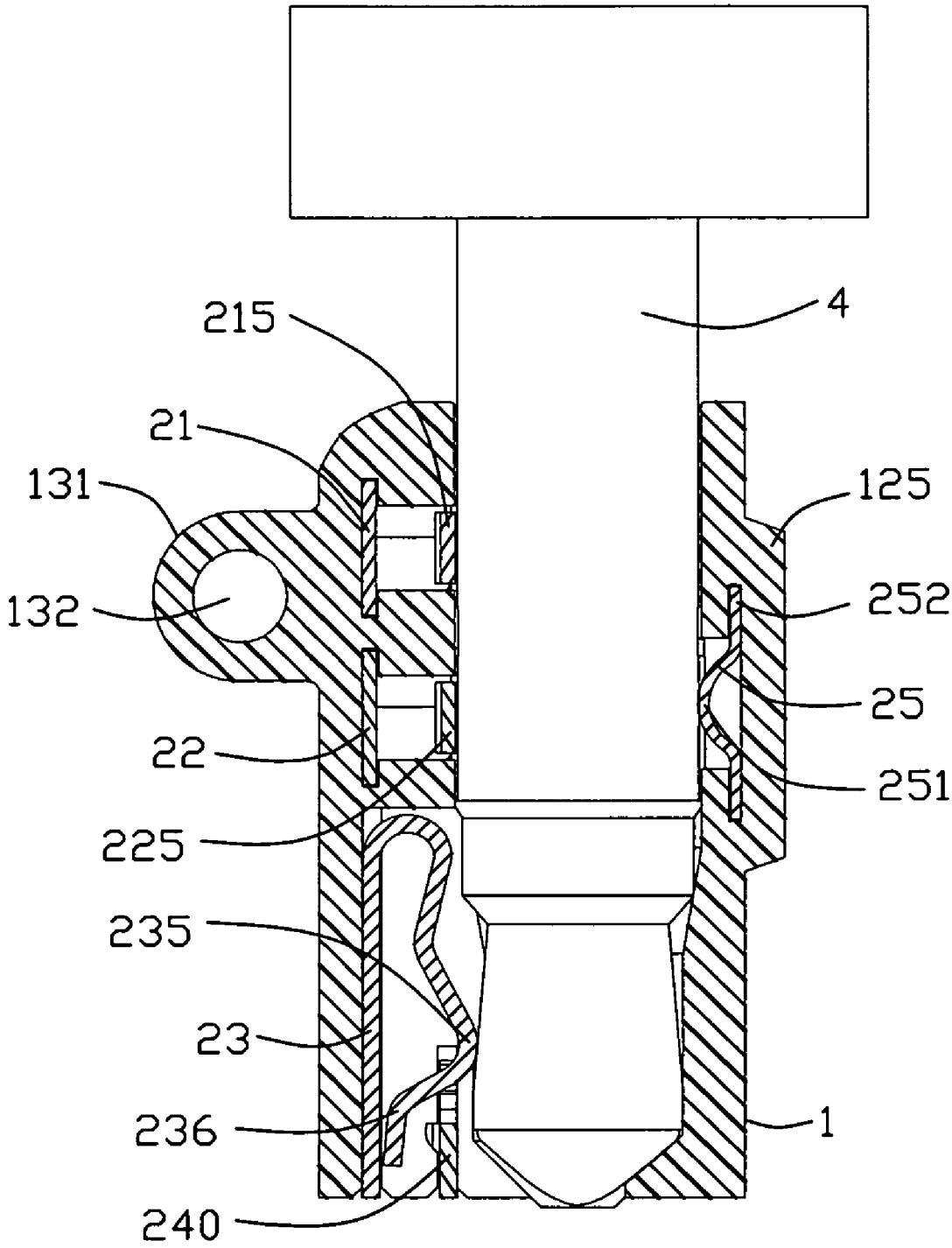
FIG. 5 is a cross-sectional view showing the electrical connector and a mating plug fully inserted into the electrical connector.
Figure 6:
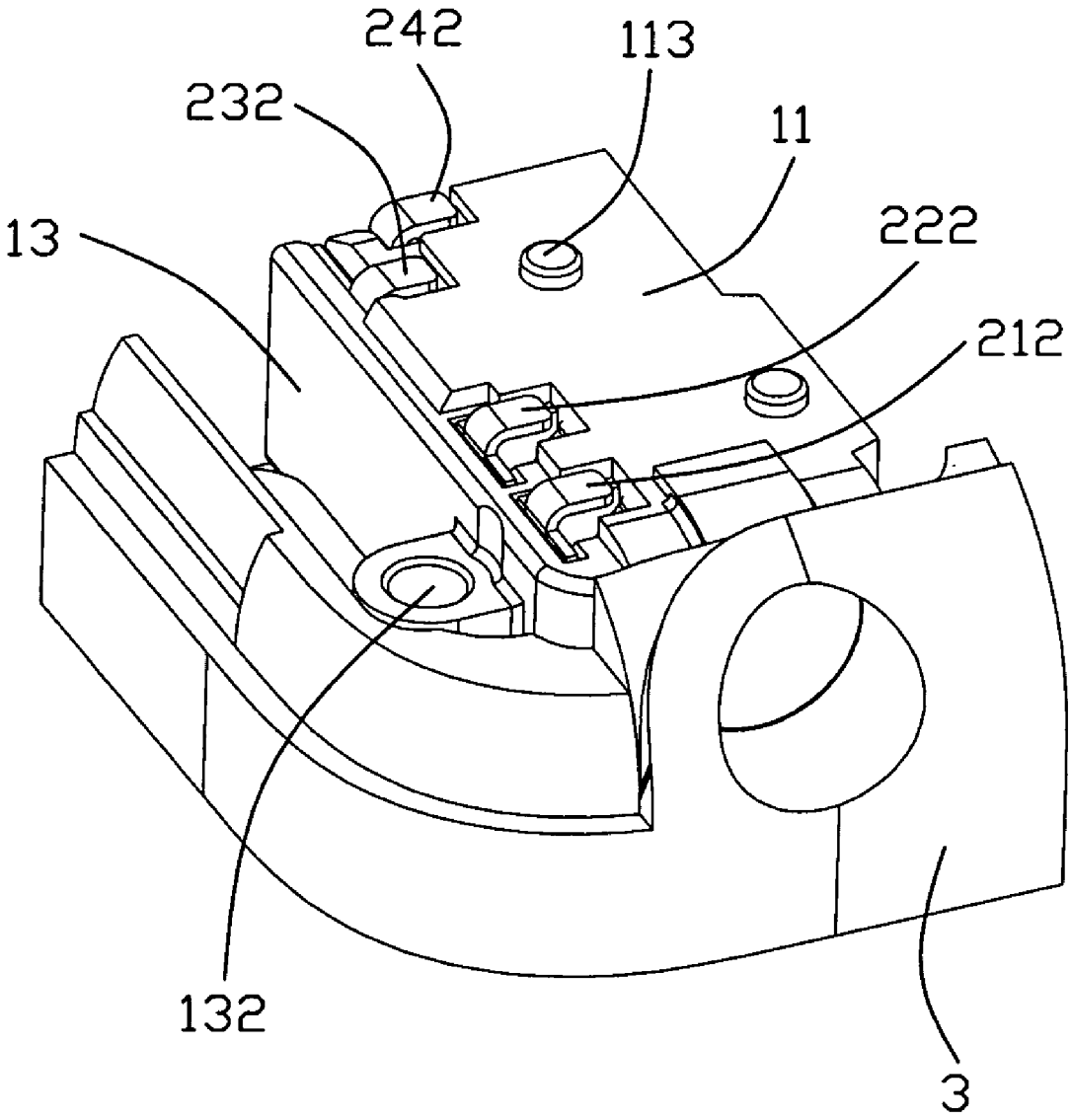
FIG. 6 is an assembled perspective view of the electrical connector and a peripheral panel to which the electrical connector is mounted.
Figure 7:
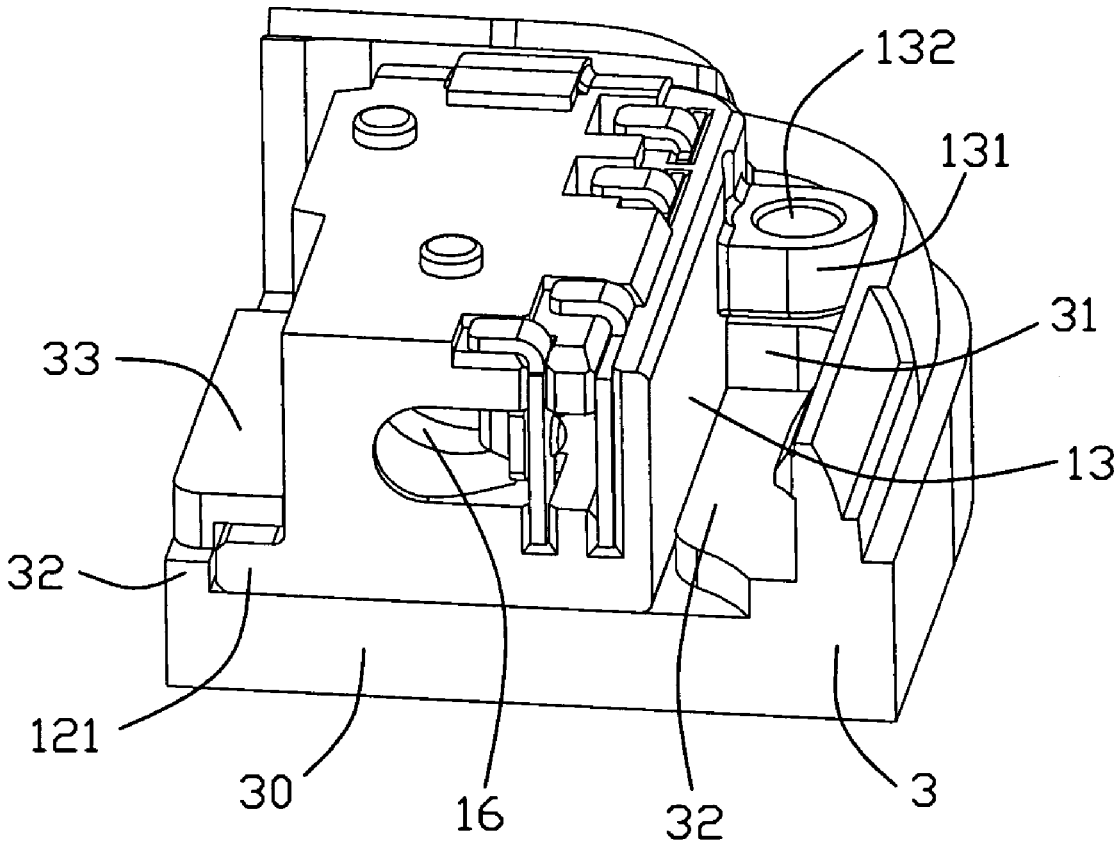
FIG. 7 is a view similar to FIG. 6, while taken from a different aspect.
Figure 8:
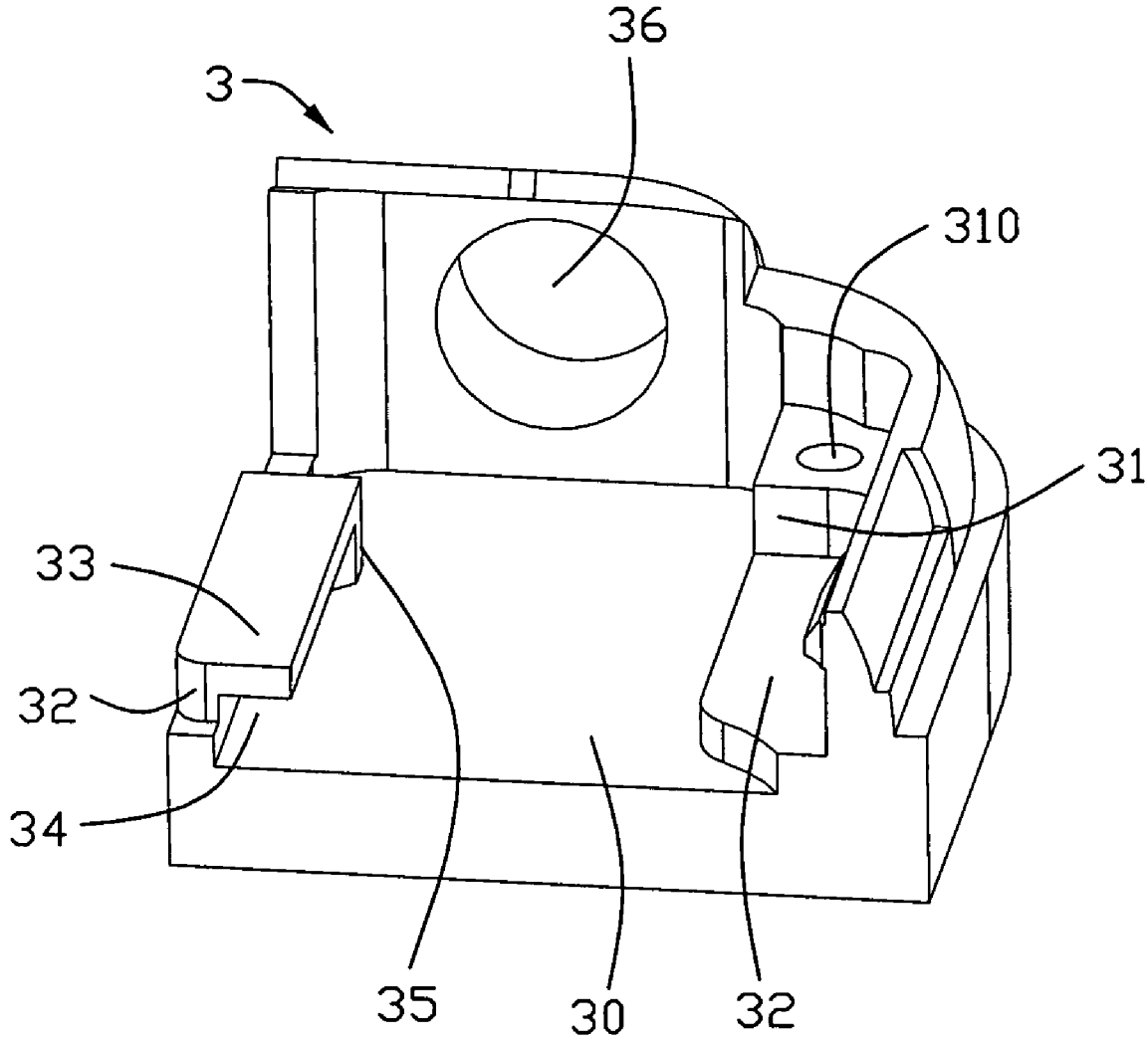
FIG. 8 is a perspective view of the peripheral panel.

Referring to FIGS. 1-6, an electrical connector 100 to be soldered on a printed circuit board and then secured to a peripheral panel 3, comprises an insulative housing 1, a plurality of electrical contacts 21, 22, 23, 24 and a spring tab 25 mounted on the housing 1. In the preferred embodiment, the electrical connector 100 is an audio jack connector.

The insulative housing 1 defines a front mating face 14, a mounting face, a receiving cavity 16 extending through the mating face 14 to receive a mating plug 4. Said housing 1 has a top wall 10, a bottom wall 11, a real wall 15 and a pair of side walls 12, 13. The mounting face is defined by a bottom surface of the bottom wall 11. A pair of mounting post 113 is provided on the bottom wall 11 to be fixed on the printed circuit board. An ear portion 131 is formed on a substantially middle portion of the right side wall 13, a screw hole 132 extends through the ear portion 131 along a top-to-bottom direction. Said ear portion 131 is to be supported by a supporting block 31 formed on the peripheral panel 3. The supporting block 31 is provided with a position hole 310 corresponding to the screw hole 132, so that a screw can lock with the screw hole 132 and the position hole 310 to secure the electrical connector 100 to the peripheral panel 3.

The peripheral panel 3 includes a front insertion hole 36 corresponding to the receiving cavity 16, a base wall 30 for supporting the top wall 10 of the housing 1, a pair of side walls 32 extending upwardly from the base wall 30, an abutting plate 33 extending laterally and inwardly from a top portion of the left side wall 32. The supporting block 31 projects upwardly from the base wall 30. A retaining slot 34 is formed between the abutting plate 33 and the base wall 30, a flat retaining plate 121 extending laterally from a rear portion of the top wall 10 of the housing 1 to be sandwiched between the base wall 30 and the abutting plate 33 and fixed in the retaining slot 34. The flat retaining plate 121 is coplanar with top wall 10. A vertical wall 35 projects upwardly from the base wall 30 to be located on a rear end of the retaining slot 34. When the electrical connector 100 is assembled onto the peripheral panel 3, the retaining plate 121 is inserted into the retaining slot 34 till the front end of retaining plate 121 abuts against the vertical wall 35, simultaneously, the screw hole 132 is precisely aligned with the position hole 310 to allow for an insertion of the screw. In this way, the electrical connector 100 is provided with the retaining plate 121 to be sandwiched between the base wall 30 and the abutting plate 33, therefore ensuring desirable securing engagement between the peripheral panel 3 and the electrical connector 100. Furthermore, there is no need to provide a screw hole on the retaining plate 121, thus simplifying the structure of the retaining plate 121.

The left side wall 12 of the housing 1 is partially cut away to form a cutout 122, a slit 125 is provided on the left side wall 12. The spring tab 25 includes an inwardly curved portion 251 and a pair of fixing ends 252 on opposite sides of the curved portion 251, the fixing ends 252 are retained in the slit 125. A plastic block 126 extends outwardly from the left side wall 12 to be located outside the slit 125, thereby avoiding a crack of the side wall 12 when the spring tab 25 is inserted into the slit 125. A recess 123 is formed on the side wall 12, in assembly, the curved portion 251 passes through the recess 123 and then extends into the receiving cavity 16.

The contacts are located on a right side of the receiving cavity 16 and include a first contact 21, a second contact 22 have a same shape as the first contact 21, a third contact 23, and a fourth contact 24. The third contact 23 and the fourth contact 24 commonly define a switch. The first contact 21 and the second contact 22 each has a vertical retaining portion 210, 220, a soldering portion 212, 222 extending from a bottom end of the retaining portion 210, 220, a spring arm 211, 221 projecting laterally and then downwardly from an upper end of the retaining portion 210, 220. A dimple 215, 225 is provided on one side of the spring arm 211, 221 to contact with the plug 4. A number of barbs 213, 223 are formed on the retaining portion 210, 220 to interferentially lock with the housing 1.

The third contact 23 and the fourth contact 24 constitute a switch to detect an insertion of the mating plug 4, and each includes a base portion 230, 240, a soldering portion 232, 242 projecting laterally from the base portion 230, 240. A spring arm 235 extends rearwardly from a front end of the base portion 230. A contacting portion 236 is formed on a distal end of the spring arm 231 and is configured to move outwardly to disengage from the base portion. 240 when the mating plug 4 deflects the spring arm 235. A plurality of barbs 233, 243 are formed on the base portion 230, 240 to interferentially lock with the housing 1.

The housing 1 includes a third longitudinal passageway 103, a fourth longitudinal passageway 104 extending through a rear side of the housing 1 to retain the base portions 230, 240 respectively. A recessed portion 114 is formed on the bottom wall 11 to receive the soldering portion 232, 242 respectively and make the soldering portion 232, 242 coplanar with the mounting face. A first upper through hole 101, a first lower through hole 111 aligned with the first upper through hole 101, a second upper through hole 102, a second lower through hole 112 aligned with the second upper through hole 102 along a height direction of the housing 1 are formed on the housing 1. The first lower through hole 111, the first upper through hole 101, the second lower through hole 112, the second upper through hole 102 each communicates with the receiving cavity 16. An upper portion of the spring arm 211, 221 extends into the first upper through hole 101, the second upper through hole 102 respectively and is movable therein. A distal end of the spring arm 211, 221 extends into the first lower through hole 111, the second lower through hole 112 respectively to preliminarily press against an inner side wall thereof and is movable therein. A third through hole 103 extends through the top wall 10 to be located above the base portion 230.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector to be mounted on a peripheral panel, comprising:

an insulative housing defining a mating face, a mounting face, a top wall, a bottom wall, a pair of side walls interconnecting the top wall and the bottom wall, and a receiving cavity extending through the mating face to receive a mating plug, an ear portion extending laterally from the side wall, a flat retaining plate extending outwardly from the side wall and being coplanar with top wall, a screw hole extending through the ear portion;

a plurality of contacts retained in the housing; and a spring tab retained in the side wall, the side wall include a cutout on an upper portion thereof and a slit located beneath the cutout, the spring tab defines a inwardly curved portion extending into the receiving cavity, and a pair of fixing ends on opposite sides of the curved portion and being retained in the slit.

2. The electrical connector as claimed in claim 1, wherein the contacts comprise a first contact and a second contact located behind the first contact.

3. The electrical connector as claimed in claim 2, wherein the first contact has a same shape as the second contact, the first contact and the second contact each includes a vertical retaining portion, a soldering portion extending from a bottom end of the retaining portion, a spring arm projecting laterally and then downwardly from an upper end of the retaining portion.

4. The electrical connector as claimed in claim 3, wherein the housing comprises a first upper through hole and a second upper through hole both extending through the top wall and communicating with the receiving cavity, the spring arm defines an upper portion extending into the first upper through hole, the second upper through hole respectively and is movable therein.

5. The electrical connector as claimed in claim 4, wherein the housing comprises a first lower through hole and a second lower through hole both extending through the bottom wall and communicating with the receiving cavity, the spring arm each defines a distal end extends into the first lower through hole, the second lower through hole respectively to preliminarily press against an inner side wall thereof and is movable therein.

6. The electrical connector as claimed in claim 5, wherein the first upper through hole is aligned with the first lower through hole and the second upper through hole is aligned with the second lower through hole along a height direction of the housing.

7. The electrical connector as claimed in claim 2, wherein the contacts further comprise a third contact and a fourth contact cooperate with the third contact to form a switch, the first contact, the second contact, the third contact and the fourth contact are located on a right side of the receiving cavity.

8. The electrical connector as claimed in claim 7, wherein the third contact and the fourth contact each includes a base portion, a soldering portion projecting laterally from the base portion, the bottom wall defines a recessed portion on a rear end thereof, the soldering portions of the third contact and the fourth contact are received in the recessed portion to be coplanar with the mounting face.

9. An electrical connector assembly, comprising:

a peripheral panel defining a base wall, a first side wall extending upwardly from the base wall, an abutting plate extending laterally from the side wall, and a position hole;

an electrical connector comprising:

an insulative housing defining a mating face, a mounting face, a top wall being supported by the base wall, a bottom wall, a pair of side walls interconnecting the top wall and the bottom wall, a plurality of passageways, and a receiving cavity extending through the mating face to receive a mating plug, an ear portion extending laterally from the side wall of the housing, a retaining plate extending laterally from the side wall of the housing to be sandwiched between the abutting plate and the base wall along a height direction of the housing, a screw hole extending through the ear portion to be aligned with the position hole;

a plurality of contacts retained in the passageways respectively.

10. The electrical connector assembly as claimed in claim 9, further comprising a spring tab retained in the side wall, the side wall include an cutout on an upper portion thereof and a slit located beneath the cutout, the spring tab defines a inwardly curved portion extending into the receiving cavity, and a pair of fixing ends on opposite sides of the curved portion and being retained in the slit.

11. The electrical connector assembly as claimed in claim 9, wherein the peripheral panel includes an vertical wall projecting upwardly from the base wall to abut against a front end of the retaining plate.

12. The electrical connector assembly as claimed in claim 9, wherein the contacts comprise a first contact and a second contact having a same shape as the first contact, the first contact and the second contact each includes a vertical retaining portion, a soldering portion extending from a bottom end of the retaining portion, a spring arm projecting laterally and then downwardly from an upper end of the retaining portion.

13. The electrical connector assembly as claimed in claim 12, wherein the housing comprises a first upper through hole and a second upper through hole both extending through the top wall and communicating with the receiving cavity, the spring arm defines an upper portion extending into the first upper through hole, the second upper through hole respectively and is movable therein.

14. The electrical connector assembly as claimed in claim 13, wherein the housing comprises a first lower through hole and a second lower through hole both extending through the bottom wall and communicating with the receiving cavity, the spring arm each defines a distal end extends into the first lower through hole, the second lower through hole respectively to preliminarily press against an inner side wall thereof and is movable therein, the first upper through hole is aligned with the first lower through hole and the second upper through hole is aligned with the second lower through hole along a height direction of the housing.

15. The electrical connector assembly as claimed in claim 9, wherein the peripheral panel includes a second side wall cooperating with the first side wall to sandwich the housing therebetween, a supporting block extends upwardly from the base wall to support the ear portion.

16. The electrical connector assembly as claimed in claim 15, wherein the peripheral panel includes a position hole formed on the supporting block and being aligned with the screw hole.

17. An electrical connector assembly comprising:

a panel including a base wall with two opposite lateral sides;

a guiding device formed on one lateral side;

a position hole in the other lateral side;

a vertical plate extending from the base wall and between said two opposite lateral sides with an insertion hole formed therein;

an electrical connector including:

an insulative housing held in the panel, said housing defining a mating face located behind the vertical plate, and a mounting face seated upon the base wall;

a receiving cavity formed in the housing and forwardly extending through the mating face and in horizontal alignment with the insertion hole;

a plurality of contacts disposed in the housing and extending into the receiving cavity;

an ear portion formed on the housing with a hole therein in vertical alignment with the position hole so as to allow a fastening device to extend therethrough and into the position hole; wherein the housing further includes a complementary guiding piece to couple to the guiding device so as to allow said housing is assembled to the panel only along a horizontal direction.

18. The assembly as claimed in claim 17, wherein said horizontal direction is an axial direction of said receiving cavity.

* * * * *